United States Patent [19]

Klimazewski

[11] 4,177,642

[45] Dec. 11, 1979

[54] DIVERTER VALVE FOR EXHAUST SYSTEM OF INTERNAL COMBUSTION ENGINE

[75] Inventor: Leo T. Klimazewski, St. Louis, Mo.

[73] Assignee: ACF Industries, Incorporated, New York, N.Y.

[21] Appl. No.: 864,054

[22] Filed: Dec. 23, 1977

[51] Int. Cl.[2] ..... F01N 3/15

[52] U.S. Cl. ..... 60/290; 60/306

[58] Field of Search ..... 60/290, 306, 284, 277

[56] References Cited

U.S. PATENT DOCUMENTS

| | | | |
|---|---|---|---|
| 3,906,723 | 9/1975 | Matumoto | 60/290 |
| 3,934,413 | 1/1976 | Beiswenger | 60/289 |

FOREIGN PATENT DOCUMENTS

| | | | |
|---|---|---|---|
| 52-46576 | 11/1977 | Japan | 60/290 |

*Primary Examiner*—Douglas Hart

*Attorney, Agent, or Firm*—Edward H. Casey; J. Joseph Muller

[57] ABSTRACT

A forced air control valve for an air injection system in an internal combustion engine has a diaphragm operated main valve member responsive to the vacuum from intake manifold to divert air from the exhaust system to atmosphere. A separate shifting or diverter valve for the exhaust system is temperature responsive and when the main valve member is open permits the supply of air to the exhaust manifold upstream of a catalytic converter only during cold engine operation. During warm engine operation when the main valve member is open, the separate shifting valve diverts the air to the catalytic converter. Upon deceleration during cold engine operation the separate diverter valve is shifted to divert air from the exhaust manifold to the catalytic converter. A temperature sensitive overheat switch is operable upon overheating of the catalyst to vent the forced air to atmosphere.

11 Claims, 6 Drawing Figures

DIVERTER VALVE FOR EXHAUST SYSTEM OF INTERNAL COMBUSTION ENGINE

BACKGROUND OF THE INVENTION

This invention relates to a forced air control valve for use in an air system which delivers air from an air pump to the exhaust system to an internal combustion engine. The air control valve may be shifted to divert air to atmosphere from the exhaust system.

Reference is made to prior U.S. Pat. No. 3,520,320 dated July 14, 1970 entitled "By-pass and Pressure Relief Valve" as an example of prior art in which a forced air control valve is provided to divert air from the exhaust system to the atmosphere particularly during deceleration to minimize or eliminate backfire conditions. The control valve in U.S. Pat. No. 3,520,320 is a diaphragm actuated valve that is spring biased in one direction with the manifold vacuum overcoming the biasing means to move the valve member to a position for venting the flow of air to atmosphere. The air is vented to atmosphere only for a predetermined period of time which is controlled by a calibrated air bleed through the diaphragm. Thus, after the air has been vented to atmosphere for such a predetermined time, the diaphragm then moves the valve to a position in which air is again supplied to the exhaust system.

DESCRIPTION OF THE PRESENT INVENTION

The air control valve of the present invention is directed to an air control valve in an air injection system for the exhaust system of an internal combustion engine. The control valve includes a main valve member responsive to a manifold vacuum and shifted between an open position to permit the supply of air to the exhaust system and a closed position blocking the flow of air to the exhaust system. A second by-pass valve member is opened when the main valve member is closed to vent the air supply to atmosphere thereby by-passing the exhaust system.

The improvement in the air control valve comprising the present invention is particularly directed to a switching valve member mounted for movement independent of the main valve member and effective to switch the air flow to the exhaust system between the exhaust manifold upstream of the catalytic converter and to the catalytic converter. The switching valve member is temperature responsive and during cold engine operation air is supplied upstream of the catalytic converter for heating the catalyst in a minimum of time. During warm engine operation the switching valve member is shifted to a second position in which air is supplied to the exhaust downstream of the catalytic converter. During both cold engine and warm engine operations, rapid deceleration of the engine will effect the closing of the main valve member and the air will be vented to atmosphere.

This invention is particularly adapted for use with a "so called" three-way catalyst in the exhaust system which controls emissions from nitrous oxides, carbon monoxide, and hydrocarbons. When air is mixed with exhaust gases while they are still hot enough to support combustion, additional burning takes place and the quantity of unburned hydrocarbons, carbon monoxide, and nitrous oxides is greatly reduced. When air is diverted to the exhaust system when the main valve member is open, the switching valve member then directs the air flow alternately between a pair of outlets which are either upstream or to the three-way catalyst depending on engine operating conditions. As indicated above, during cold engine operation when the main valve member is open the air is diverted by the switching valve to the exhaust manifold which is upstream of the three-way catalyst, and during warm engine operation, the air is diverted to the three-way catalyst.

Another feature of the invention includes a temperature sensitive overheat switch operatively connected to the three-way catalyst and effective upon the catalyst reaching a predetermined high temperature to cause immediate venting of the air flow to atmosphere to by-pass the exhaust system. This permits the overheating of the catalyst to be reduced before air is again supplied to the exhaust system.

A secondary valve member for by-passing air to atmosphere also acts as a pressure relief so that air supplied by the air pump to the air control valve may be relieved in the event it reaches a predetermined high pressure.

BRIEF DESCRIPTION OF THE DRAWINGS

The foregoing and other objects, features and advantages of the invention will be apparent from the following more particular description of preferred embodiments of the invention, as illustrated in the accompanying drawings, and reference characters refer to the same parts throughout the different views.

Referring now to FIG. 1 of the drawings, internal combustion engine 10 drives an air pump 12 which supplies air through conduit 14 to the inlet 16 of an air control valve forming this invention and indicated generally at 18. An exhaust system for internal combustion engine 10 includes an exhaust manifold indicated at 20 and an exhaust pipe 22 extending from exhaust manifold 20. Mounted in exhaust pipe 22 is a three-way catalytic converter indicated at 24. The so-called three-way catalytic converter is intended to convert nitrous oxides, hydrocarbons, and carbon monoxide. Internal combustion engine 10 also includes an intake manifold 26 having a carburetor 28 communicating therewith and a throttle valve 30 in carburetor 28 mounted over intake manifold 26. An air cleaner 32 is mounted on the upper end of carburetor 28.

Figure 1:
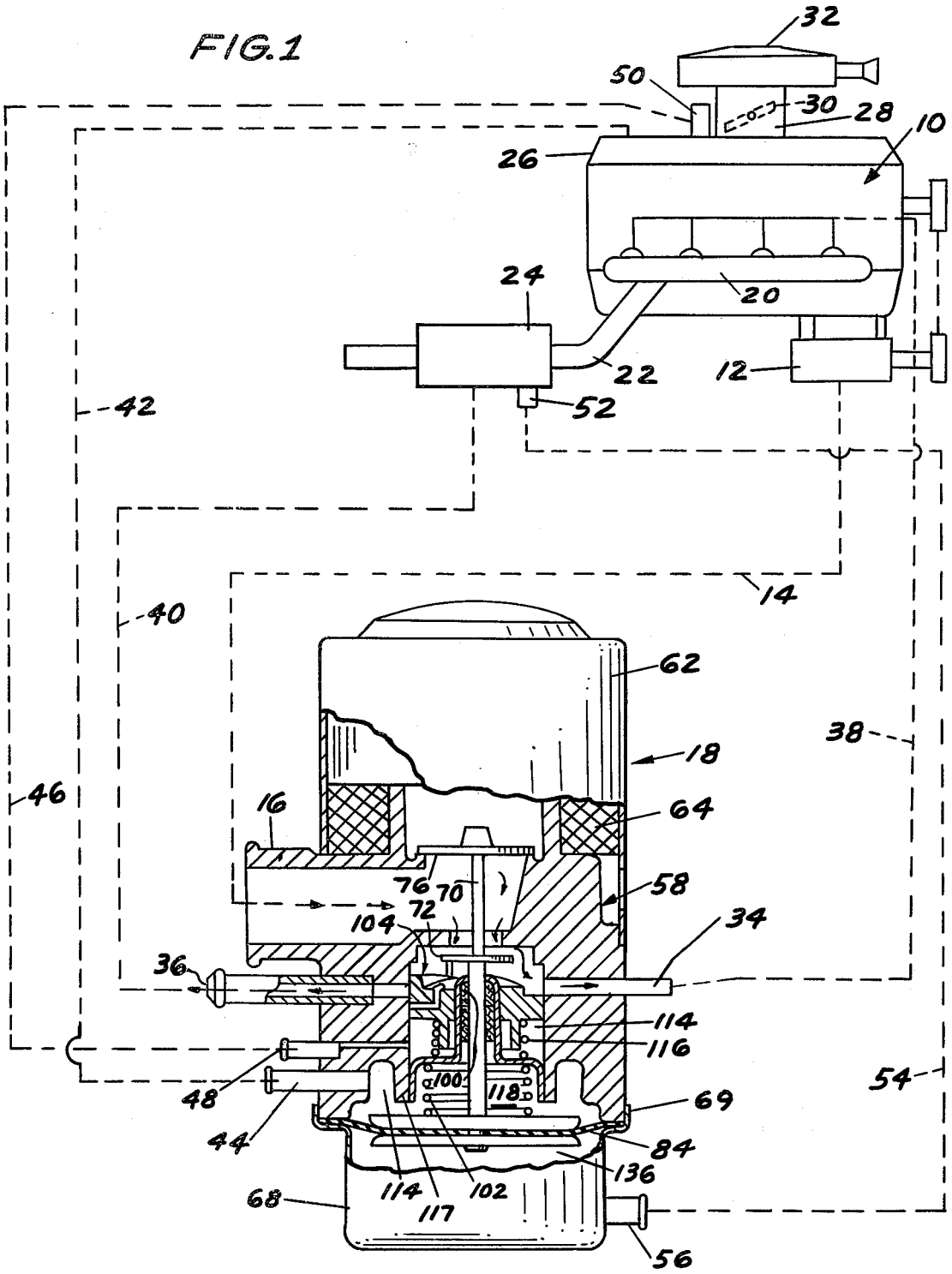
FIG. 1 is a partially schematic view of an internal combustion engine having an air pump for delivering air to the exhaust system and showing the air control valve of the present invention in an enlarged sectional view with the main valve member in an open position to supply air from the air pump to the exhaust manifold as occurs during cold engine operation.

Air control valve 18 has air outlets 34 and 36 thereon formed by suitable nipples. Air outlet 34 is connected by a line 38 to exhaust manifold 20. Air outlet 36 is connected by a line 40 to catalytic converter 24. A vacuum line 42 extends from intake manifold 26 to a vacuum nipple 44 of control valve 18. An additional vacuum line 46 extends from vacuum nipple 48 to intake manifold 26 adjacent the idle enrichment. Vacuum line 46 is controlled by a temperature activated ported vacuum switch indicated schematically at 50 and provided in the water jacket of internal combustion engine 10. The ported vacuum switch is open during cold engine operation to permit a vacuum through line 46 to nipple 48 but when the engine is warm, switch 50 blocks or interrupts the vacuum exerted through line 46 to nipple 48. The vacuum from intake manifold 26 through line 42 is in continuous communication with nipple 44.

A temperature sensitive overheat switch indicated schematically at 52 is responsive to the temperature of the three-way catalytic converter 24 and is connected by a line 54 to nipple 56 of control valve 18. When the catalyst in converter 24 reaches a predetermined high temperature, temperature sensitive overheat switch 52 is activated to open or bleed line 54 to atmosphere.

Referring now in detail to control valve 18, the main body is indicated at 58 and has a central bore with inlet 16, outlets 34 and 36, and vacuum nipples 44 and 48 thereof leading therefrom. Main body 58 has an upper cylindrical extension 60 which forms an air by-pass port 61 to atmosphere. An upper housing 62 is fitted on body 58 over extension 60 and has sound deadening material 64 therein for muffling noises. Air emerging from by-pass port 61 travels upwardly and then downwardly along a plurality of channels 66 spaced about the outer circumference of body 58. Openings 67 in housing 62 communicate with channels 66 of body 58 for venting by-pass port 61 to atmosphere.

A lower cap or housing 68 has its peripheral edge 69 crimped about body 58 and nipple 56 communicates with the enclosed space formed by housing 68. Nipple 56 is connected by line 54 to temperature activated overheat switch 52 and vents the space in housing 68 to atmosphere upon activation of switch 52 during an overheat condition in catalytic converter 24 as will be explained.

Figure 2:
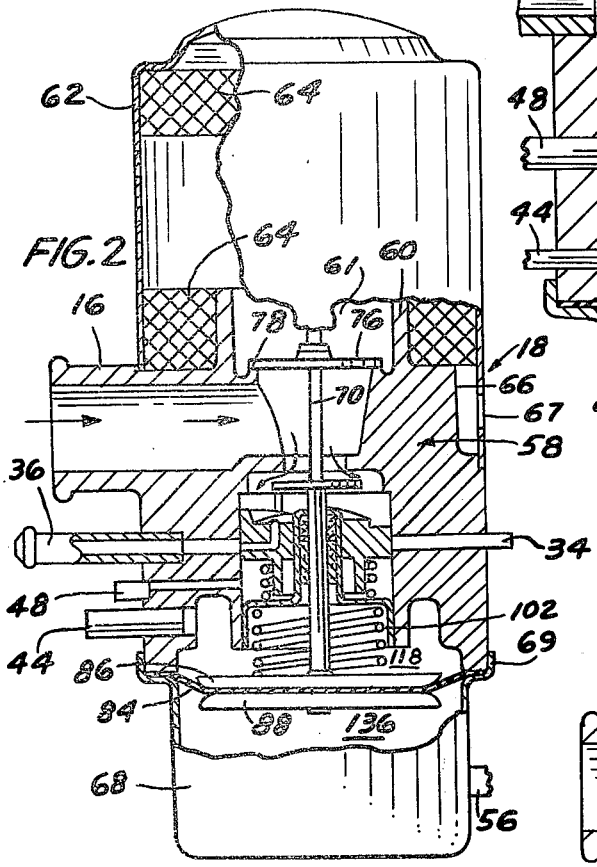
FIG. 2 is an elevational view of the air control valve of FIG. 1 with certain parts broken away and illustrating the main valve member in an open position with air being supplied to the catalytic converter as occurs during warm engine operation.

A main valve stem 70 has a main valve member 72 thereon which is adapted to seat in a closed position on seat 74 of main body 58. A by-pass or vent valve member 76 on stem 70 is adapted to seat on valve seat 78 of main body 58 in a closed position. Main valve member 72 and vent valve member 76 are fixed to stem 70. The surface area of by-pass valve member 76 exposed to air from inlet 16 is larger than the surface area of main valve member 72 exposed to inlet air. Thus, when main valve member 72 is open as shown in FIG. 2, by-pass valve member 76 will act as a pressure relief upon the reaching of an excessively high pressure and shift by-pass valve member 76 to an open position to relieve the excessive pressure while closing main valve member 72.

A diaphragm 84 is connected to an end of stem 70 and is secured along its outer peripheral edge by the crimped edge 69 of housing 68. Diaphragm 84 is clamped between an upper metal retaining plate 86 and a lower metal retaining plate 88 as will be explained in detail further. As shown particularly in FIG. 4, a fixed guide indicated generally at 90 is mounted within bore portion 92 of the central bore of main body 58. Guide 90 includes a lower large diameter base portion 94 and an upper reduced diameter end portion 96 which receives stem 70. Mounted in reduced diameter end portion 96 is a bearing sleeve 98 and a suitable packing 100. A spring 102 is biased between upper diaphragm plate 86 and base 94 to urge continuously diaphragm 84 and stem 70 to a downward position viewing FIGS. 2–4.

Figure 4:
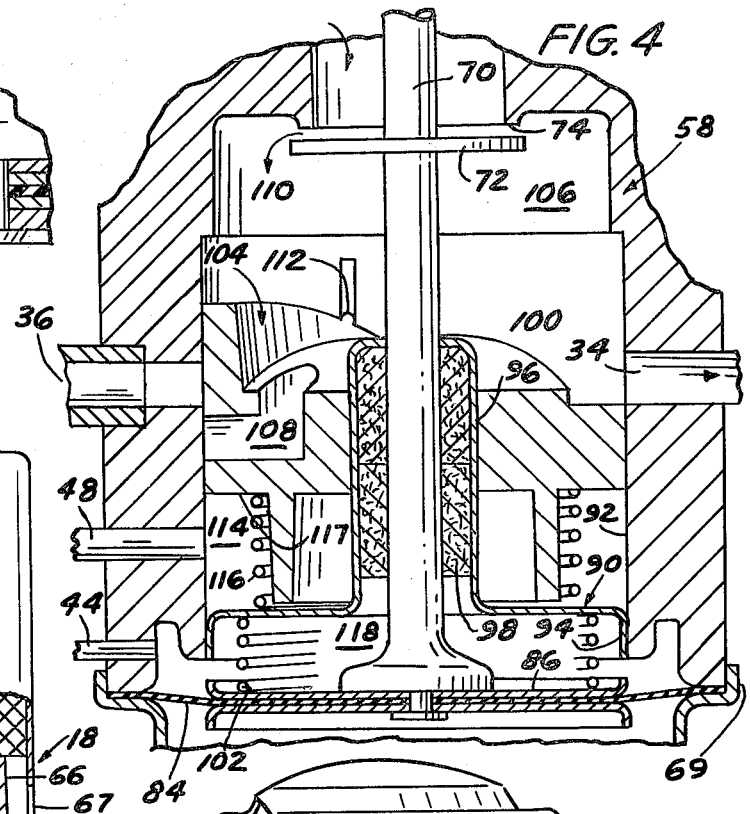
FIG. 4 is an enlarged fragment of FIG. 1 showing the switching valve member adjacent the main valve member for alternating air flow between two air outlets and in a position to permit a supply of air to the exhaust manifold upstream of the catalytic converter.

Mounted within bore portion 92 for relative sliding movement about reduced diameter end portion 96 is a diverter or switching piston valve member generally indicated at 104 movable between two positions communicating alternately with outlets 34 and 36. As shown in FIG. 4, piston valve member 104 permits the communication of a main air chamber 106 formed above piston valve member 104 to communicate alternately with outlets 34 and 36. An opening 108 is provided in switching valve member 104 and permits fluid communication between outlet 36 and main air chamber 106 when piston valve member 104 is in its uppermost position as shown in FIG. 2. To prevent rotative movement of piston valve member 104 on stem 70, a slot 110 is provided in the inner wall of valve body 58 and a guide 112 on piston valve member 104 is received within vertical slot 110 to prevent piston valve member 104 from rotating. Guide 112 acts as a stop to limit the upward movement of piston valve member 104 for alignment with outlets 34 and 36. Vacuum line 48 communicates with a vacuum chamber 114 for valve member 104 and a spring 116 is biased between guide 90 and an annular flange 117 on the underside of piston valve member 104 to continuously urge piston valve member 104 upwardly. Vacuum line 44 is in communication with main vacuum chamber 118 and spring 102 is mounted in main vacuum chamber 118.

Figure 5:
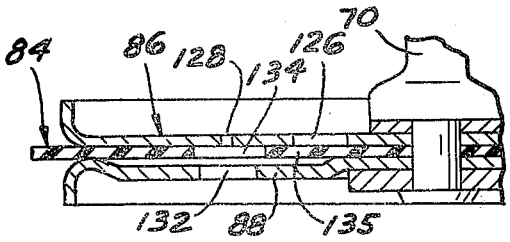
FIG. 5 is an enlarged sectional view of the diaphragm mounted between a pair of metal plates and illustrating the air bleed between opposite sides of the diaphragm for equalizing the pressure therebetween.
Figure 6:
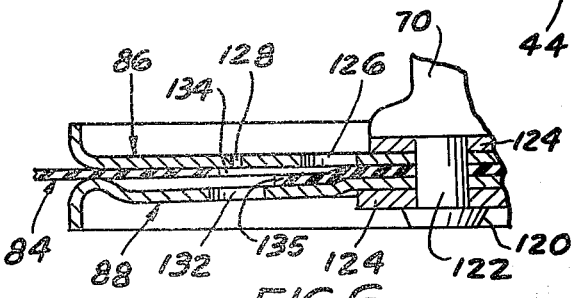
FIG. 6 is a sectional view similar to FIG. 5 but showing the diaphragm in the position as occurs during rapid acceleration.

Referring to FIGS. 5 and 6, details of the construction of the diaphragm assembly to permit venting of the air to atmosphere during deceleration for a predetermined time are illustrated. Head 120 on a reduced diameter portion 122 of stem 70 carries a pair of spaced washers 124 which retain upper support plate 86 and lower support plate 88 on opposite sides of diaphragm 84. Upper plate 86 has a plurality of apertures or openings 126 and a calibrated bleed opening 128 therein. Lower plate 88 has a plurality of apertures 132. Diaphragm 84 has an arcuate cutaway portion 134 which forms a flap 135 which acts as a valve during operation of the assembled unit.

Housing 68 provides a closed air chamber 136 except for nipple 56 connected to line 54 extending to overheat switch 52 for catalyst 24. When the pressures in air chamber 136 and vacuum chamber 118 are the same diaphragm 84 has no effect on the operation of the valve. However, upon a rapid deceleration the vacuum in line 44 applied against vacuum chamber 118 increases substantially and a pressure differential exists between air chamber 136 and vacuum chamber 118 to move diaphragm 84 upwardly to unseat by-pass valve member 76 and vent the air supply to atmosphere through openings 67. This condition is shown in FIG. 5 in which flap 135 seals the relatively large openings 126. The speed at which vent valve 76 reseats is controlled by the size of the bleed hole or opening 128 which provides a delay in the reseating of vent valve member 76.

Figure 3:
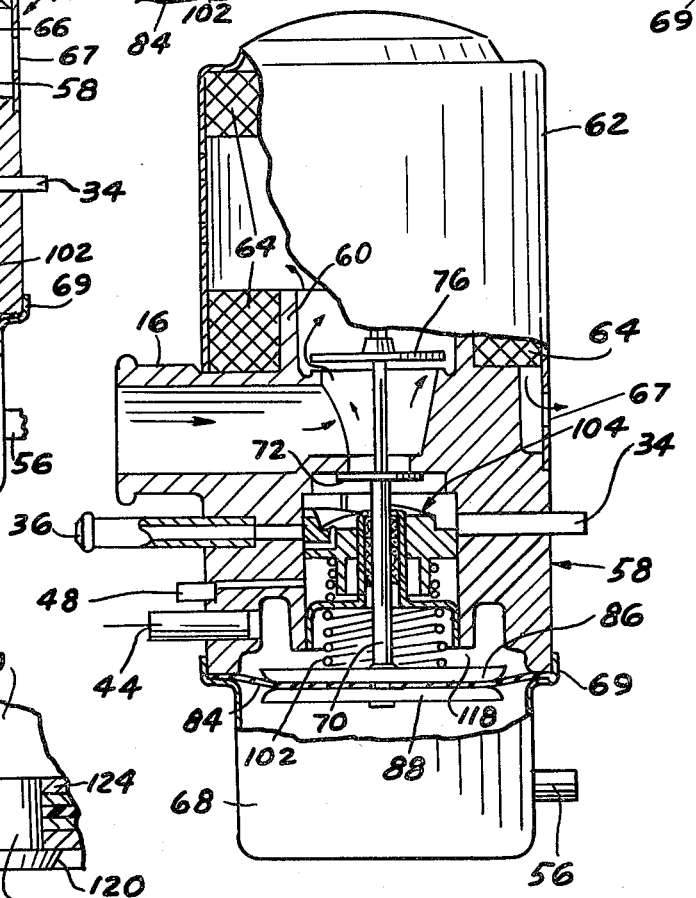
FIG. 3 is an elevational view with certain parts broken away similar to FIG. 2 but showing the main valve member in a closed position and the secondary by-pass valve member open for venting the air flow to atmosphere.

In operation, during engine operation pump 12 continuously supplies air through line 14 to inlet 16 of control valve 18 where it enters control valve 18. During cold engine operation, vacuum line 46 is open and a vacuum is exerted within piston vacuum chamber 114 thereby to move piston valve member 104 to the position shown in FIGS. 1 and 4 in which air is supplied through outlet 34 and line 38 to the exhaust manifold to aid in the heating of catalytic converter 24. During this operation valve 72 is in an open position as spring 102 urges stem 70 downwardly since the pressures in chambers 118 and 136 are generally equalized. The supply of air to exhaust manifold 20 results in a relatively fast heating of catalytic converter 24 during cold engine operation. Upon deceleration during cold engine operation, a relatively large vacuum is exerted through line 42 and nipple 44 to main vacuum chamber 118 which results in a pressure differential between main vacuum chamber 118 and enclosed air chamber 136 with diaphragm 84 and stem 70 moving upwardly thereby closing main valve member 72 and opening vent valve 78 to vent the air to atmosphere as shown in FIG. 3. Even though main valve member 72 is closed as shown in FIG. 3, piston valve member 104 will remain in a down position blocking outlet 36 during cold engine operation. However, during warm engine operation piston valve member 104 would be in its upper position with opening 108 aligned with outlet 36. When the pressures are equalized between chamber 118 and chamber 136 by the bleeding of air through bleed opening 128, diaphragm 84 and stem 70 will move downwardly opening main valve member 72 and closing vent valve member 76.

When the engine reaches a predetermined warm temperature, temperature actuated vacuum switch 50 in line 46 vents line 46 to atmosphere and no vacuum is then exerted against switching valve member 104 within piston vacuum chamber 114. Spring 116 then urges piston valve member 104 to its upper position in which position opening 108 is aligned with outlet 36 and outlet 34 is blocked as shown in FIG. 2. Thus, during normal warm engine operation, main valve member 72 is open and air is supplied through outlet 36 and line 40 to catalytic converter 24. During warm engine operation at least a partial vacuum exists in both main vacuum chamber 118 and enclosed air chamber 136 and a sudden acceleration increases the pressure in the intake manifold thereby to increase the pressure in the main vacuum chamber 118. In this event, air will flow from chamber 118 to chamber 136 to equalize the pressure and flap 135 is moved away from the large diameter openings 126 as shown in FIG. 6 to provide a relatively fast rate of flow from chamber 118 to chamber 136 for equalizing the pressure. A partial vacuum at least is always present in chambers 118 and 136 during normal engine operation. When the catalyst in catalytic converter 24 reaches a predetermined excessively high amount overheat switch 52 will be actuated to vent line 54 and chamber 136 to atmosphere. The increase in pressure in chamber 136 results in an upward movement of diaphragm 84 and the closing of main valve member 72 with the simultaneous opening of bypass valve member 76 for venting the flow of air to atmosphere. When the temperature in catalytic converter 24 is reduced to a safe level, switch 52 automatically closes to block line 54 to atmosphere.

For further details in regard to the operation of diaphragm 84, reference is made to the aforementioned U.S. Pat. No. 3,520,320 dated July 14, 1970 and entitled "By-pass and Pressure Relief Valve". In addition, copending application Ser. No. 864,138 filed Dec. 23, 1977 entitled "Forced Air Control Valve for Exhaust System of an Internal Combustion Engine" shows a somewhat similar air control valve but without a vent opening to atmosphere.

The present invention provides an air control valve for an exhaust system of an internal combustion engine which permits the flow of air to the exhaust manifold upstream of the catalytic converter during cold engine operation and upon warm engine operation the air flow switches to the catalytic converter. In addition, deceleration under both cold engine and warm engine conditions results in the venting of the air flow to the atmosphere for a limited predetermined period of time. This eliminates a possible backfire condition as it is desirable to vent at least part of the air flow to atmosphere during rapid deceleration. After rapid deceleration the vent to atmosphere will remain open for a period of around three (3) to eight (8) seconds, for example, assuming the pressure differential between the main vacuum chamber and the enclosed air space is around five (5) to ten (10) inches of mercury. The vacuum which is utilized for shifting piston valve member 104 between outlets 34 and 36 is effective only during cold engine operation. Thus, air is supplied to exhaust manifold 20 only during cold engine operation and even under cold engine operation if a rapid deceleration occurs, the air flow will be shifted to the atmosphere for around three (3) to eight (8) seconds when main valve member 76 is closed. Upon the reopening of main valve member 76 after deceleration during cold engine operation air will be supplied to the exhaust manifold again.

What is claimed is:

1. An air control valve for use on an internal combustion system having an exhaust manifold and an exhaust pipe extending from the exhaust manifold with a catalytic converter in the exhaust pipe, and an air pump for supplying air to the exhaust system, said air control valve comprising:

a valve body having a central bore forming an air chamber, an air inlet extending to the air chamber, and at least a pair of air outlets leading from the air chamber, one of said air outlets being connected to the exhaust system upstream of the catalytic converter and the other outlet being connected to the catalytic converter;

valve means positioned in the chamber between the outlets and shifting alternately between open and closed positions of the outlets, the inlet being in fluid communication with one outlet when the valve means is in one position and in fluid communication with the other outlet when the valve means is in another position;

a valve stem positioned in said air chamber having said valve means mounted thereon;

a main diaphragm assembly on the valve body and connected to an end of the valve stem, spring biasing means to urge the diaphragm assembly and the valve means to a position for supplying air to the exhaust system, a vacuum chamber for said valve means, a vacuum line extending from the intake manifold of the internal combustion engine to the vacuum chamber, and temperature responsive means operatively connected to said vacuum line to permit the exertion of a vacuum against the valve means during cold engine operation to permit movement of the valve means to a position for the supply of air to the exhaust system upstream of the catalytic converter, said temperature responsive means being operable to interrupt the exertion of a vacuum against the valve means through said vacuum line during warm engine operation to permit movement of the valve means to a position for the supply of air to the catalytic converter.

2. An air control valve as set forth in claim 1 wherein said valve means includes a main valve member between the inlet and said outlets controlling the air flow between the inlet and said outlets and movable between open and closed positions, said valve means further including a switching valve member downstream of the main valve member and between the pair of outlets, said switching valve member movable independently of the main valve member and shifting alternately between the pair of outlets for permitting the supply of air alternately to the exhaust manifold and to the catalytic converter.

3. An air control valve as set forth in claim 2 wherein said switching valve member is responsive to said vacuum chamber and to said temperature responsive means and is effective only during cold engine operation.

4. An air control valve for use on an internal combustion engine exhaust system having an exhaust manifold and an exhaust pipe extending from the exhaust manifold with a catalytic converter in the exhaust pipe, and an air pump for supplying air to the exhaust system, said air control valve comprising:

a valve body having a central bore forming an air chamber, an air inlet extending to the air chamber, and at least a pair of air outlets leading from the air chamber, one of said air outlets being connected to the exhaust manifold upstream of the catalytic converter and the other outlet being connected to the catalytic converter;

valve means positioned in the chamber between the outlets and shifting alternately between open and closed positions of the outlets, the inlet being in fluid communication with one outlet when the valve means is in one position and in fluid communication with the other outlet when the valve means is in another position;

a valve stem positioned in said air chamber having said valve means mounted thereon;

a main diaphragm assembly on the valve body and connected to an end of the valve stem, spring biasing means to urge the diaphragm assembly and the valve means to a position for supplying air to the exhaust system, a vacuum chamber for said valve means, a vacuum line extending from the intake manifold of the internal combustion engine to the vacuum chamber, and temperature responsive means operatively connected to said vacuum line to permit the exertion of a vacuum against the valve means during cold engine operation to permit movement of the valve means to a position for the supply of air to the exhaust manifold upstream of the catalytic converter, said temperature responsive means being operable to interrupt the exertion of a vacuum against the valve means through said vacuum line during warm engine operation to permit movement of the valve means to a position for the supply of air to the catalytic converter;

a second vacuum chamber in said air control valve, a separate vacuum line extending from the intake manifold of the internal combustion engine to the second vacuum chamber, said valve means during cold engine operation upon a rapid deceleration being responsive to the sudden vacuum change in the second vacuum chamber to divert air away from the exhaust manifold upstream of the catalytic converter; and means to limit for a predetermined period of time the diverting of air away from the exhaust manifold during rapid deceleration under cold engine operation.

5. An air control valve as set forth in claim 4 wherein said valve means includes a main valve member and a by-pass valve member mounted on said stem, said by-pass valve member being in fluid communication with atmosphere and venting the air supply to atmosphere when in an open position, said main valve member being between the inlet and said pair of outlets and movable between open and closed positions.

6. In an internal combustion engine exhaust system of the type wherein a catalytic converter is positioned in an exhaust pipe and forced air is injected into the exhaust system through a forced air passage, an improved automatically actuated control valve in said forced air passage for controlling the flow of air through said forced air passage to the exhaust system wherein the improvement comprises;

a valve body having a central bore including an inlet, a pair of outlets and a by-pass, said inlet being in fluid communication with a forced air source, one of said outlets being in fluid communication with an exhaust manifold upstream of the catalytic converter and the other outlet being in fluid communication with the catalytic converter, and said by-pass being in fluid communication with atmosphere;

a main valve member between the inlet and said outlets controlling the air flow between the inlet and said outlets and movable between open and closed positions, a by-pass valve member between the inlet and said by-pass controlling the air flow between the inlet and said by-pass;

a valve stem positioned in said central bore and having mounted thereon said main valve member and said by-pass valve member;

a diaphragm assembly on the main body and connected to an end of said valve stem, spring biasing means to urge said diaphragm assembly and said main valve member toward an open position, said valve body having a main manifold vacuum chamber on one side of said main diaphragm assembly in fluid communication with an intake manifold of said internal combustion engine;

a separate diverter valve member mounted between said pair of outlets and shifting alternately between the pair of outlets for permitting the supply of air alternately to the exhaust manifold upstream of the catalytic converter and to the catalytic converter when the main valve member is open, a separate vacuum chamber for the diverter valve member on one side of the diverter valve member, a separate vacuum line from the intake manifold of the internal combustion engine to the separate vacuum chamber, and temperature responsive means operatively connected to said separate vacuum line to permit the exertion of a vacuum against the diverter valve member during cold engine operation to permit the supply of air to the exhaust manifold, said temperature responsive means being operable to interrupt the vacuum during warm engine operation to shift the diverter valve member to a position to permit the supply of air to the catalytic converter.

7. In an internal combustion engine exhaust system as set forth in claim 6 wherein said diverter valve member is mounted on said valve stem for longitudinal movement relative to the stem and main valve member, said diverter valve member being positioned downstream of said main valve member and effective to control the air flow only when the main valve member is open.

8. In an internal combustion engine exhaust system as set forth in claim 7 wherein said diverter valve member is a piston mounted in the central bore downstream of the main valve member.

9. In an internal combustion engine exhaust system as set forth in claim 8 wherein means in said central bore cooperate with said piston to prevent rotative movement of the piston relative to the stem.

10. In an internal combustion engine exhaust system of the type wherein a catalytic converter is positioned in an exhaust pipe and forced air is injected into the exhaust system through a forced air passage, an improved automatically actuated control valve in said forced air passage for controlling the flow of air through said forced air passage to the exhaust system wherein the improvement comprises:

a valve body having a central bore including an inlet, a pair of outlets and a by-pass, said inlet being in fluid communication with a forced air source, one of said outlets being in fluid communication with an exhaust manifold upstream of the catalytic converter and the other outlet being in fluid communication with the catalytic converter, and said by-pass being in fluid communication with atmosphere;

a main valve member between the inlet and said outlets controlling the air flow between the inlet and said outlets and movable between open and closed positions, a by-pass valve member between the inlet and said by-pass controlling the air flow between the inlet and said by-pass, a diverter valve member mounted downstream of the main valve member between said pair of outlets for permitting the supply of air alternately between the pair of outlets;

a valve stem positioned in said central bore and having mounted thereon said main valve member, said by-pass valve member, and said diverter valve member;

a diaphragm assembly on the main body and connected to an end of said valve stem, spring biasing means to urge said diaphragm assembly and said main valve member toward an open position, said valve body having a main manifold vacuum chamber on one side of said main diaphragm assembly in fluid communication with an intake manifold of said internal combustion engine;

a separate vacuum chamber for the diverter valve member on one side of the diverter valve member, a separate vacuum line from the intake manifold of the internal combustion engine to the separate vacuum chamber, and temperature responsive means operatively connected to said separate vacuum line to permit the exertion of a vacuum against the diverter valve member during cold engine operation to permit the supply of air to the exhaust manifold, said temperature responsive means being operable to interrupt the vacuum during warm engine operation to shift the diverter valve member to a position to permit the supply of air to the catalytic converter;

said main valve member and said by-pass valve member being mounted for alternate opening and closing and responsive to a sudden vacuum change in the main vacuum chamber upon rapid deceleration for opening the by-pass valve member and closing the main valve member thereby to vent the air flow to atmosphere.

11. The internal combustion engine exhaust system as defined in claim 10 wherein means limit for a predetermined period of time the opening of the by-pass valve member for venting the air flow to atmosphere.

* * * * *